US007455249B2

(12) United States Patent
Cedoz

(10) Patent No.: US 7,455,249 B2
(45) Date of Patent: Nov. 25, 2008

(54) COMBINED DIRECT AND INDIRECT CHARGING SYSTEM FOR ELECTROSTATICALLY-AIDED COATING SYSTEM

(75) Inventor: Roger T. Cedoz, Curtice, OH (US)

(73) Assignee: Illinois Tool Works Inc., Glenview, IL (US)

( * ) Notice: Subject to any disclaimer, the term of this patent is extended or adjusted under 35 U.S.C. 154(b) by 193 days.

(21) Appl. No.: 11/390,848

(22) Filed: Mar. 28, 2006

(65) Prior Publication Data

US 2007/0235571 A1 Oct. 11, 2007

(51) Int. Cl.
*B05B 5/00* (2006.01)

(52) U.S. Cl. ..... 239/691; 239/700; 239/690; 239/707; 118/621

(58) Field of Classification Search ..... 239/609–708; 118/621
See application file for complete search history.

(56) References Cited

U.S. PATENT DOCUMENTS

| | | | |
|---|---|---|---|
| 1,655,262 | A | 1/1928 | Fortin |
| 2,547,440 | A | 4/1951 | Clark et al. |
| 2,673,232 | A | 3/1954 | Silsby, Jr. |
| 2,890,388 | A | 6/1959 | Croskey et al. |
| 2,960,273 | A | 11/1960 | Croskey et al. |
| 3,098,890 | A | 7/1963 | Peterson |
| 3,122,320 | A | 2/1964 | Beck et al. |
| 3,291,889 | A | 12/1966 | Uline et al. |
| 3,393,662 | A | 7/1968 | Blackwell |
| 3,408,985 | A | 11/1968 | Sedlacsik, Jr. |
| 3,851,618 | A | 12/1974 | Bentley |
| 3,875,892 | A | 4/1975 | Gregg et al. |
| 3,893,620 | A | 7/1975 | Rokadia |
| 3,894,272 | A | 7/1975 | Bentley |
| 3,933,285 | A | 1/1976 | Wiggins |
| 3,934,055 | A | 1/1976 | Tamny |
| 3,937,400 | A | 2/1976 | Krause |
| 3,940,061 | A | 2/1976 | Gimple et al. |

(Continued)

FOREIGN PATENT DOCUMENTS

| | | |
|---|---|---|
| GB | 1 393 333 | 5/1975 |

(Continued)

OTHER PUBLICATIONS

"REA-90 and REA-90L Electrostatic Spray Guns Dual Atomization Technology", Service Manual, Ransburg, 2005 Illinois Tool Works Inc.

(Continued)

*Primary Examiner*—Dinh Q Nguyen
(74) *Attorney, Agent, or Firm*—Barnes & Thornburg LLP

(57) ABSTRACT

An electrostatically aided coating atomizing and dispensing apparatus includes an atomizer, a voltage block, a source of electrically non-insulative coating material to be dispensed from the atomizer, an indirect charging apparatus, and at least one source of high magnitude electrical potential. The source of electrically non-insulative coating material is coupled to an input port of the voltage block. An output port of the voltage block is coupled to the atomizer. The indirect charging apparatus is operatively mounted with respect to the atomizer. The at least one source of high magnitude electrical potential is coupled to an input port of the atomizer and to an input port of the indirect charging apparatus.

1 Claim, 2 Drawing Sheets

U.S. PATENT DOCUMENTS

| | | | | |
|---|---|---|---|---|
| 3,952,951 | A | | 4/1976 | Raetz et al. |
| 3,964,683 | A | | 6/1976 | Gimple |
| 3,990,609 | A | | 11/1976 | Grant |
| 4,001,935 | A | | 1/1977 | Krohn et al. |
| 4,002,777 | A | | 1/1977 | Juvinall et al. |
| 4,017,029 | A | | 4/1977 | Walberg |
| 4,020,866 | A | | 5/1977 | Wiggins |
| 4,030,857 | A | | 6/1977 | Smith, Jr. |
| 4,037,561 | A | | 7/1977 | LaFave et al. |
| 4,075,677 | A | | 2/1978 | Bentley |
| 4,081,904 | A | | 4/1978 | Krohn et al. |
| 4,085,892 | A | | 4/1978 | Dalton |
| 4,105,164 | A | | 8/1978 | Lau et al. |
| 4,114,564 | A | | 9/1978 | Probst |
| 4,114,810 | A | | 9/1978 | Masuda |
| 4,116,364 | A | | 9/1978 | Culbertson et al. |
| 4,133,483 | A | | 1/1979 | Henderson |
| 4,143,819 | A | | 3/1979 | Hastings |
| D252,097 | S | | 6/1979 | Probst et al. |
| 4,165,022 | A | | 8/1979 | Bentley et al. |
| 4,169,545 | A | | 10/1979 | Decker |
| 4,174,070 | A | | 11/1979 | Lau et al. |
| 4,174,071 | A | | 11/1979 | Lau et al. |
| 4,187,527 | A | | 2/1980 | Bentlry |
| 4,214,709 | A | | 7/1980 | Scull et al. |
| 4,248,386 | A | | 2/1981 | Morle |
| 4,275,834 | A | | 6/1981 | Spanjersberg et al. |
| 4,275,838 | A | | 6/1981 | Fangmeyer |
| 4,313,475 | A | | 2/1982 | Wiggins |
| 4,324,812 | A | | 4/1982 | Bentley |
| 4,331,298 | A | | 5/1982 | Bentley et al. |
| RE30,968 | E | | 6/1982 | Grant |
| 4,337,282 | A | | 6/1982 | Springer |
| 4,361,283 | A | | 11/1982 | Hetherington et al. |
| 4,381,079 | A | | 4/1983 | Allen |
| 4,383,644 | A | | 5/1983 | Spanjersberg et al. |
| D270,179 | S | | 8/1983 | Grime |
| D270,180 | S | | 8/1983 | Grime |
| D270,367 | S | | 8/1983 | Grime |
| D270,368 | S | | 8/1983 | Grime |
| 4,401,268 | A | | 8/1983 | Pomponi, Jr. |
| 4,413,788 | A | | 11/1983 | Schaefer et al. |
| 4,433,812 | A | | 2/1984 | Grime |
| 4,437,614 | A | | 3/1984 | Garcowski |
| 4,447,008 | A | | 5/1984 | Allen |
| 4,453,670 | A | | 6/1984 | Sirovy |
| 4,483,483 | A | | 11/1984 | Grime |
| 4,485,427 | A | | 11/1984 | Woodruff et al. |
| 4,505,430 | A | | 3/1985 | Rodgers et al. |
| 4,506,260 | A | | 3/1985 | Woodruff et al. |
| 4,513,913 | A | | 4/1985 | Smith |
| 4,529,131 | A | | 7/1985 | Rutz |
| 4,537,357 | A | | 8/1985 | Culbertson et al. |
| 4,606,501 | A | | 8/1986 | Bate et al. |
| 4,613,082 | A | | 9/1986 | Gimple et al. |
| D287,266 | S | | 12/1986 | Knetl et al. |
| 4,629,119 | A | * | 12/1986 | Plunkett et al. ..... 239/63 |
| 4,702,420 | A | | 10/1987 | Rath |
| 4,745,520 | A | | 5/1988 | Hughey |
| 4,747,546 | A | | 5/1988 | Talacko |
| 4,759,502 | A | | 7/1988 | Pomponi, Jr. et al. |
| 4,760,962 | A | | 8/1988 | Wheeler |
| 4,760,965 | A | | 8/1988 | Schneider |
| 4,770,117 | A | | 9/1988 | Hetherington et al. |
| 4,771,729 | A | | 9/1988 | Planert et al. |
| 4,771,949 | A | | 9/1988 | Behr et al. |
| 4,792,092 | A | | 12/1988 | Elberson et al. |
| 4,844,342 | A | | 7/1989 | Foley |
| D303,139 | S | | 8/1989 | Morgan |
| 4,852,810 | A | | 8/1989 | Behr et al. |
| 4,872,616 | A | | 10/1989 | Behr et al. |
| 4,878,622 | A | | 11/1989 | Jamison et al. |
| 4,879,137 | A | | 11/1989 | Behr et al. |
| D305,057 | S | | 12/1989 | Morgan |
| 4,884,752 | A | | 12/1989 | Plummer |
| D305,452 | S | | 1/1990 | Morgan |
| D305,453 | S | | 1/1990 | Morgan |
| 4,911,367 | A | | 3/1990 | Lasley |
| 4,921,169 | A | | 5/1990 | Tilly |
| 4,927,079 | A | | 5/1990 | Smith |
| 4,932,589 | A | | 6/1990 | Diana |
| 4,934,603 | A | | 6/1990 | Lasley |
| 4,934,607 | A | | 6/1990 | Lasley |
| 4,955,960 | A | | 9/1990 | Behr et al. |
| 4,982,903 | A | | 1/1991 | Jamison et al. |
| 4,993,645 | A | | 2/1991 | Buschor |
| 5,022,590 | A | | 6/1991 | Buschor |
| D318,712 | S | | 7/1991 | Buschor |
| 5,033,942 | A | | 7/1991 | Petersen |
| 5,054,687 | A | | 10/1991 | Burns et al. |
| 5,064,119 | A | | 11/1991 | Mellette |
| 5,074,466 | A | | 12/1991 | Santiago |
| 5,078,168 | A | | 1/1992 | Konieczynski |
| 5,085,373 | A | | 2/1992 | Behr et al. |
| 5,090,623 | A | | 2/1992 | Burns et al. |
| 5,094,389 | A | | 3/1992 | Giroux et al. |
| 5,096,126 | A | | 3/1992 | Giroux et al. |
| D325,241 | S | | 4/1992 | Buschor |
| 5,118,080 | A | | 6/1992 | Hartmann |
| 5,119,992 | A | | 6/1992 | Grime |
| 5,154,357 | A | | 10/1992 | Jamison et al. |
| 5,154,358 | A | * | 10/1992 | Hartle ..... 239/697 |
| 5,159,544 | A | | 10/1992 | Hughey et al. |
| 5,178,330 | A | | 1/1993 | Rodgers |
| 5,180,104 | A | | 1/1993 | Mellette |
| 5,193,750 | A | | 3/1993 | LaMontagne et al. |
| 5,197,676 | A | | 3/1993 | Konieczynski et al. |
| 5,208,078 | A | | 5/1993 | Ishibashi et al. |
| 5,209,365 | A | | 5/1993 | Wood |
| 5,209,405 | A | | 5/1993 | Robinson et al. |
| 5,221,194 | A | | 6/1993 | Konieczynski et al. |
| 5,236,129 | A | | 8/1993 | Grime et al. |
| 5,255,856 | A | | 10/1993 | Ishibashi et al. |
| 5,271,569 | A | | 12/1993 | Konieczynski et al. |
| 5,284,299 | A | | 2/1994 | Medlock |
| 5,284,301 | A | | 2/1994 | Kieffer |
| 5,288,029 | A | | 2/1994 | Ishibashi et al. |
| 5,289,974 | A | | 3/1994 | Grime et al. |
| 5,299,740 | A | | 4/1994 | Bert |
| 5,303,865 | A | | 4/1994 | Bert |
| 5,326,031 | A | | 7/1994 | Konieczynski |
| 5,330,108 | A | | 7/1994 | Grime et al. |
| 5,332,156 | A | | 7/1994 | Wheeler |
| 5,332,159 | A | | 7/1994 | Grime et al. |
| D349,559 | S | | 8/1994 | Vanderhoef et al. |
| 5,340,289 | A | | 8/1994 | Konieczynski et al. |
| 5,341,990 | A | | 8/1994 | Konieczynski |
| 5,351,887 | A | | 10/1994 | Heterington et al. |
| 5,395,054 | A | | 3/1995 | Wheeler |
| 5,400,971 | A | | 3/1995 | Maugans et al. |
| 5,433,387 | A | | 7/1995 | Howe et al. |
| 5,518,186 | A | | 5/1996 | Weinstein |
| 5,526,986 | A | * | 6/1996 | Padgett et al. ..... 239/690 |
| 5,538,186 | A | | 7/1996 | Konieczynski |
| 5,549,755 | A | | 8/1996 | Milovich et al. |
| 5,553,788 | A | | 9/1996 | Del Gaone et al. |
| 5,582,350 | A | | 12/1996 | Kosmyna et al. |
| 5,618,001 | A | | 4/1997 | Del Gaone et al. |
| 5,622,563 | A | | 4/1997 | Howe et al. |
| 5,632,448 | A | | 5/1997 | Alexander et al. |
| 5,632,816 | A | * | 5/1997 | Allen et al. ..... 118/629 |
| 5,633,306 | A | | 5/1997 | Howe et al. |
| 5,639,027 | A | | 6/1997 | Fritz |
| 5,655,896 | A | | 8/1997 | Konieczynski |

| | | | |
|---|---|---|---|
| 5,662,278 | A | 9/1997 | Howe et al. |
| 5,707,013 | A | 1/1998 | Konieczynski |
| 5,725,150 | A | 3/1998 | Allen et al. |
| 5,727,931 | A | 3/1998 | Lash et al. |
| RE35,769 | E | 4/1998 | Grime et al. |
| 5,737,174 | A | 4/1998 | Konieczynski |
| 5,746,831 | A | 5/1998 | Allen et al. |
| 5,759,277 | A | 6/1998 | Milovich et al. |
| 5,787,928 | A | 8/1998 | Allen et al. |
| RE35,883 | E | 9/1998 | Konieczynski |
| 5,803,313 | A | 9/1998 | Flatt et al. |
| 5,829,679 | A | 11/1998 | Strong |
| 5,836,517 | A | 11/1998 | Burns et al. |
| 5,944,045 | A | 8/1999 | Allen et al. |
| 5,957,395 | A | 9/1999 | Howe et al. |
| RE36,378 | E | 11/1999 | Mellette |
| 5,978,244 | A | 11/1999 | Hughey |
| 6,021,965 | A | 2/2000 | Hartle |
| 6,042,030 | A | 3/2000 | Howe et al. |
| 6,076,751 | A | 6/2000 | Austin et al. |
| 6,144,570 | A | 11/2000 | Hughey |
| 6,179,223 | B1 | 1/2001 | Sherman et al. |
| 6,189,809 | B1 | 2/2001 | Schwebemeyer |
| 6,230,993 | B1 | 5/2001 | Austin et al. |
| 6,276,616 | B1 | 8/2001 | Jenkins |
| 6,402,058 | B2 | 6/2002 | Kaneko et al. |
| 6,423,142 | B1 | 7/2002 | Hughey |
| 6,423,143 | B1 | 7/2002 | Allen et al. |
| 6,460,787 | B1 | 10/2002 | Hartle et al. |
| 6,562,137 | B2 | 5/2003 | Hughey |
| 6,572,029 | B1 | 6/2003 | Holt |
| 6,669,112 | B2 | 12/2003 | Reetz, III et al. |
| 6,698,670 | B1 | 3/2004 | Gosis et al. |
| 6,712,292 | B1 | 3/2004 | Gosis et al. |
| 2003/0006322 | A1 | 1/2003 | Hartle et al. |

FOREIGN PATENT DOCUMENTS

| | | | |
|---|---|---|---|
| GB | 1 478 853 | | 7/1977 |
| GB | 2 166 982 | A | 5/1986 |
| JP | 51-54638 | | 5/1976 |
| JP | 54-101843 | | 8/1979 |
| JP | 3-178354 | | 8/1991 |
| JP | 4-66149 | | 2/1992 |
| JP | 4-200662 | | 7/1992 |
| JP | 4-267961 | | 9/1992 |
| JP | 5-115815 | | 5/1993 |
| JP | 6-198228 | | 7/1994 |
| JP | 7-88407 | | 4/1995 |
| WO | WO 2005/014178 | A1 | 2/2005 |

OTHER PUBLICATIONS

REA-90A and REA-90LA Automatic Electrostatic Spray Guns Dual Atomization Technology Service Instruction, ITW Ransburg Electrostatic Systems, 2004 Illinois Tool Works Inc.

"REA-70 and REA-70L Electrostatic Spray Guns Dual Atomization Technology" Service Manual, Ransburg, 2005 Illinois Tool Works Inc.

"REA-III and REA-IIIL Delta Electrostatic Spray Guns Dual Atomization Technology" Service Instruction ITW Ransburg Electrostatic Systems.

"REA-IV and REA-IVL Delta Electrostatic Spray Guns Dual Atomization Technology" ITW Ransburg Electrostatic Systems.

"M90 Handguns" Service Manual.

"Aerobell & Aerobell Plus Rotary Atomizers" Service Manual, ITW Ransburg Electrostatic Systems.

* cited by examiner

COMBINED DIRECT AND INDIRECT CHARGING SYSTEM FOR ELECTROSTATICALLY-AIDED COATING SYSTEM

FIELD OF THE INVENTION

This invention relates to coating material atomizing, charging and dispensing systems including devices for electrically isolating coating dispensing equipment which is maintained at high-magnitude electrostatic potential from coating material sources supplying the coating dispensing equipment. Such devices are commonly known, and are generally referred to hereinafter, as voltage blocks.

BACKGROUND OF THE INVENTION

Various types of electrostatically aided coating equipment are known. There are, for example, the devices and systems illustrated and described in U.S. Pat. Nos. 6,423,143; 6,021,965; 5,944,045; RE35,883; 5,787,928; 5,759,277; 5,746,831; 5,737,174; 5,727,931; 5,725,150; 5,707,013; 5,655,896; 5,632,816; 5,549,755; 5,538,186; 5,526,986; 5,518,186; 5,341,990; 5,340,289; 5,326,031; 5,288,029; 5,271,569; 5,255,856; 5,221,194; 5,208,078; 5,197,676; 5,193,750; 5,154,357; 5,096,126; 5,094,389; 5,078,168; 5,033,942; 4,982,903; 4,932,589; 4,921,169; 4,884,752; 4,879,137; 4,878,622; 4,792,092; 4,771,729; 4,413,788; 4,383,644; 4,313,475; 4,275,834; 4,085,892; 4,020,866; 4,017,029; 3,937,400; 3,934,055; 3,933,285; 3,893,620; 3,291,889; 3,122,320; 3,098,890; 2,673,232; 2,547,440; and, 1,655,262; as well as WO 2005/014178; GB2,166,982; U.K. Patent Specifications 1,393,333 and 1,478,853; JP4-267961; JP4-200662; JP7-88407; JP51-54638; JP54-101843; JP4-66149; JP3-178354; JP3217394 and, JP3378058. U.S. Pat. No. 4,337,282 is also of interest. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

One characteristic typically associated with systems of the types illustrated and described in these disclosures is that the high magnitude potential applied to the dispensing device also appears across the voltage block. This potential results in electrical stress to voltage block components, which can ultimately lead to the failure of such components. Because of this, efforts have been directed toward reducing the magnitude of the potential applied to the atomizer, in order to reduce voltage stress on components of the voltage block. However, in the past, such efforts often have had a deleterious effect on the efficiency with which atomized coating material particles are transferred to the articles (hereinafter sometimes targets) which are to be coated by the atomized coating material particles. This is to be understood. In the prior art, reduced high magnitude potential means reduced transfer of electrons to the coating material particles as they are atomized.

This application describes an effort to reverse the reduced transfer efficiency which in the past has attended reducing the magnitude of the potential supplied to the atomizer.

DISCLOSURE OF THE INVENTION

According to an aspect of the invention, an electrostatically aided coating atomizing and dispensing apparatus comprises an atomizer, a voltage block, a source of electrically non-insulative coating material to be dispensed from the atomizer, an indirect charging apparatus, and first and second sources of high magnitude electrical potential. The source of electrically non-insulative coating material is coupled to an input port of the voltage block. An output port of the voltage block is coupled to the atomizer. The indirect charging apparatus is operatively mounted with respect to the atomizer. The first source of high magnitude electrical potential is coupled to an input port of the atomizer. The second source of high magnitude electrical potential is coupled to an input port of the indirect charging apparatus.

According to another aspect of the invention, an electrostatically aided coating atomizing and dispensing apparatus comprises an atomizer, a voltage block, a source of electrically non-insulative coating material to be dispensed from the atomizer, an indirect charging apparatus, and a source of high magnitude electrical potential. The source of electrically non-insulative coating material is coupled to an input port of the voltage block. An output port of the voltage block is coupled to the atomizer. The indirect charging apparatus is operatively mounted with respect to the atomizer. The source of high magnitude electrical potential is coupled to an input port of the atomizer and to an input port of the indirect charging apparatus.

Further illustratively according to this aspect of the invention, the apparatus includes a voltage divider. The source of high magnitude electrical potential is coupled to at least one of an input port of the atomizer and an input port of the indirect charging apparatus through the voltage divider.

Illustratively according to this aspect of the invention, the voltage divider is selectively adjustable.

BRIEF DESCRIPTION OF THE DRAWINGS

The invention may best be understood by referring to the following detailed description of an illustrative embodiment and accompanying drawings. In the drawings.

DETAILED DESCRIPTIONS OF ILLUSTRATIVE EMBODIMENTS

As used in this application, terms such as "electrically conductive" and "electrically non-insulative" refer to a broad range of conductivities electrically more conductive than materials described as "electrically non-conductive" and "electrically insulative." Terms such as "electrically semiconductive" refer to a broad range of conductivities between electrically conductive and electrically non-conductive.

Figure 1:
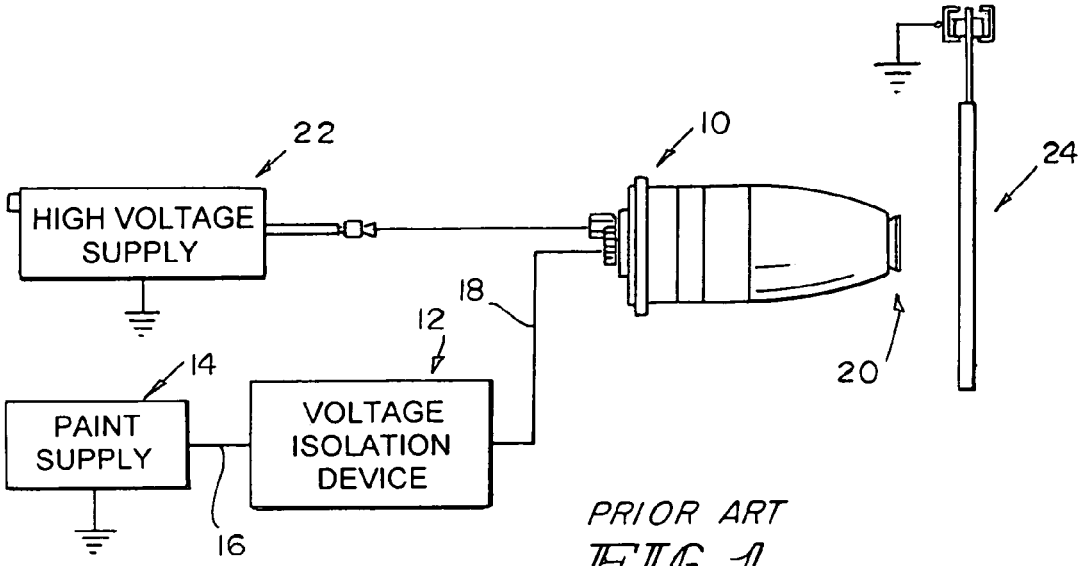
PRIOR ART FIG. 1
FIG. 1 illustrates a highly diagrammatic side elevational view of a prior art system.

Referring now to FIG. 1, many prior art systems 10 have been designed to effect electrostatically aided atomization and dispensing of electrically non-insulative, for example, water base, coatings using voltage blocks 12, for example, voltage blocks of the types illustrated in various ones of the above-identified U.S. and foreign patents and published applications. In such installations, a supply 14 of electrically non-insulative, for example, water base, coating material is coupled through a delivery conduit 16 to an input port of voltage block 12.

An output port of voltage block 12 is coupled through a delivery conduit 18 to an input port of an atomizer 20, for example, a high- or low-pressure air assisted or airless manual or automatic spray atomizer of the general type illustrated and described in any of the following U.S. Patents and published applications: 2003/0006322; U.S. Pat. Nos. 6,712,292; 6,698,670; 6,669,112; 6,572,029; 6,460,787; 6,402,058; RE36,378; U.S. Pat. Nos. 6,276,616; 6,189,809; 6,179,223; 5,836,517; 5,829,679; 5,803,313; RE35,769; U.S. Pat. Nos. 5,639,027; 5,618,001; 5,582,350; 5,553,788; 5,400,971; 5,395,054; D349,559; U.S. Pat. Nos. 5,351,887; 5,332,159; 5,332,156; 5,330,108; 5,303,865; 5,299,740; 5,289,974; U.S. Pat. Nos. 5,284,301; 5,284,299; 5,236,129; 5,209,405; 5,209,365; 5,178,330; 5,119,992; 5,118,080; 5,180,104; D325,241; U.S. Pat. Nos. 5,090,623; 5,074,466; 5,064,119; 5,054,687; D318,712; U.S. Pat. Nos. 5,022,590; 4,993,645; 4,934,607; 4,934,603; 4,927,079; 4,911,367; D305,453; D305,452; D305,057; D303,139; U.S. Pat. Nos. 4,844,342; 4,770,117; 4,760,962; 4,759,502; 4,747,546; 4,702,420; 4,613,082; 4,606,501; D287,266; U.S. Pat. Nos. 4,537,357; 4,529,131; 4,513,913; 4,483,483; 4,453,670; 4,437,614; 4,433,812; 4,401,268; 4,361,283; D270,368; D270,367; D270,180; D270,179; RE30,968; U.S. Pat. Nos. 4,331,298; 4,248,386; 4,214,709; 4,174,071; 4,174,070; 4,169,545; 4,165,022; D252,097; U.S. Pat. Nos. 4,133,483; 4,116,364; 4,114,564; 4,105,164; 4,081,904; 4,037,561; 4,030,857; 4,002,777; 4,001,935; 3,990,609; 3,964,683; and, 3,940,061; and, the Ransburg model REA 3, REA 4, REA 70, REA 90, REM and M-90 guns, all available from ITW Ransburg, 320 Phillips Avenue, Toledo, Ohio, 43612-1493; or a rotary atomizer of the general type illustrated and described in any of U.S. Pat. Nos. 6,230,993; 6,076,751; 6,042,030; 5,957,395; 5,662,278; 5,633,306; 5,632,448; 5,622,563; 4,505,430; 5,433,387; 4,447,008; 4,381,079; and, 4,275,838; and, "Aerobell™ Powder Applicator ITW Automatic Division" and "Aerobell™ & Aerobell Plus™ Rotary Atomizer, DeVilbiss Ransburg Industrial Liquid Systems." The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

In such installations, a source 22 of high magnitude electrical potential providing a voltage in the range of, for example, −40 KV to −100 KV, is coupled to an input port of atomizer 20 to provide electrical charge to the particles of coating material as they are atomized by atomizer 20. Source 22 may be, for example, of the general type illustrated and described in any of U.S. Pat. Nos. 6,562,137; 6,423,142; 6,144,570; 5,978,244; 5,159,544; 4,745,520; 4,506,260; 4,485,427; 4,324,812; 4,187,527; 4,075,677; 3,894,272; 3,875,892; and, 3,851,618. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

High magnitude potential is coupled from source 22 to the general region of the atomizer 20 where atomization and dispensing of the particles toward a target 24 being conveyed past the atomizer 20 on, for example, a grounded conveyor 26, is taking place. The particles are charged as they are dispensed. Owing to their charge, the particles are attracted toward the target 24 in accordance with well-known principles. Shunting of the high magnitude potential from source 22 to ground, for example, through the typically grounded coating material supply 14 is prevented by the voltage block 12 coupled between the high magnitude potential source 22 and the coating material supply 14.

Figure 2:
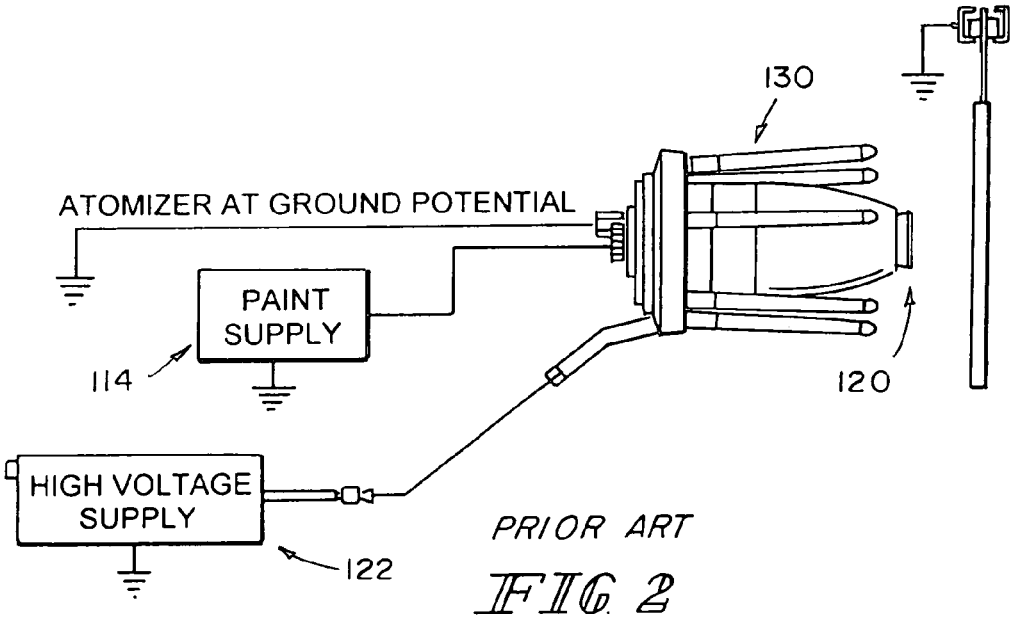
PRIOR ART FIG. 2
FIG. 2 illustrates a highly diagrammatic side elevational view of another prior art system.

In another prior art system 100 illustrated in FIG. 2, an atomizer 120 of any of the general types described above, or other well-known type, is provided with an indirect charging device 130, for example, one of the general type illustrated and described in U.S. Pat. Nos. 5,085,373; 4,955,960; 4,872,616; 4,852,810; 4,771,949; 4,760,965; 4,143,819; 4,114,810; 3,408,985; 3,952,951; 3,393,662; 2,960,273; and, 2,890,388.

In such installations, a supply 114 of electrically non-insulative, for example, water base, coating material is coupled directly to an input port of atomizer 120, for example, an atomizer of the general type illustrated and described in any of the above identified U.S. Patents and published applications. A source 122 of high magnitude electrical potential providing a voltage in the range of, for example, −40 KV to −100 KV, is coupled to the indirect charging device 130. Again, the source 122 of high magnitude potential may be, for example, of the general type illustrated and described in any of the above identified U.S. Patents. In this system, the electrically non-insulative coating material is dispensed prior to charging and is indirectly charged by corona discharge from the indirect charging device 130. Since no continuous path exists between the indirect charging device 130 and the coating material supply 114, shunting of the high magnitude potential source 122 to ground is avoided.

Figure 3:
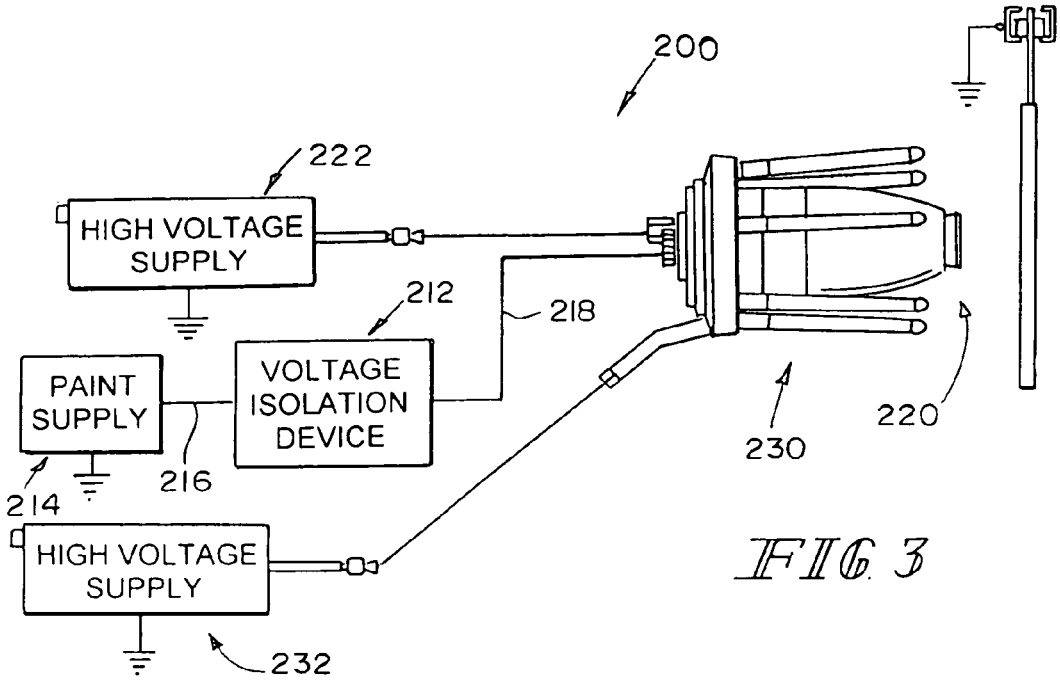
FIG. 3 illustrates a highly diagrammatic side elevational view of a system constructed according to the invention and, FIG. 4 illustrates a highly diagrammatic side elevational view of another system constructed according to the invention.

FIG. 3 illustrates a system 200 constructed according to the present invention. In the illustrated system, a supply 214 of electrically non-insulative, for example, water base, coating material is coupled through a delivery conduit 216 to an input port of a voltage block 212. An output port of the voltage block 212 is coupled through a delivery conduit 218 to an input port of an atomizer 220, for example, an atomizer of the general type illustrated and described in any of the above identified U.S. Patents. A source 222 of high magnitude electrical potential providing a voltage in the range of, for example, −40 KV to −100 KV, is coupled to an input port of the atomizer 220 to provide electrical charge to the particles of coating material as they are atomized. The source 222 of high magnitude potential may be, for example, of the general type illustrated and described in any of the above identified U.S. Patents. The atomizer 220 is further provided with an indirect charging device 230, for example, one of the general type illustrated and described in the above identified U.S. Patents. A source 232 of high magnitude electrical potential providing a voltage in the range of, for example, −40 KV to −100 KV, is coupled to the indirect charging device 230. The source 232 of high magnitude potential may be, for example, of the general type illustrated and described in any of the above identified U.S. Patents.

Figure 4:
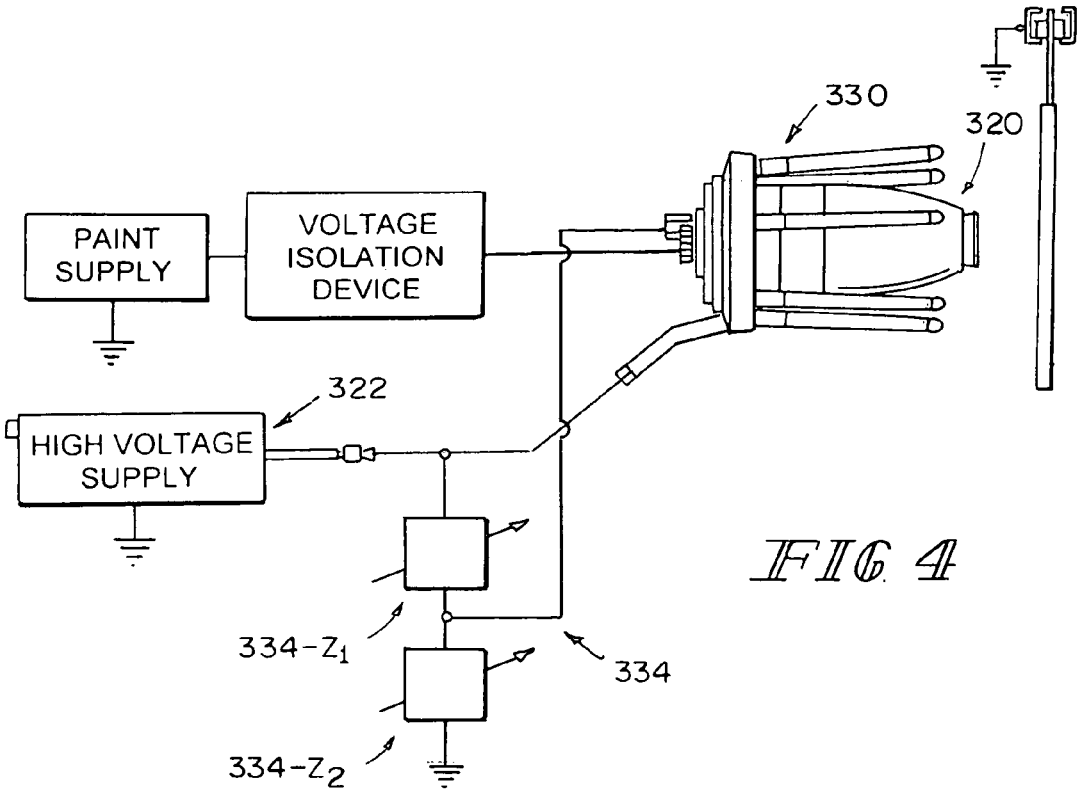

This arrangement permits sources 222 and 232 to be controlled independently of each other. In certain installations, this flexibility may not be necessary, or the expense of separate supplies warranted. In such circumstances the arrangement illustrated in FIG. 4 may be employed. In FIG. 4, a high impedance voltage divider 334 including fixed or variable impedance elements 334-$Z_1$ and 334-$Z_2$ may be provided to divide the voltage provided at the output port of a single high magnitude potential source 322 for coupling to whichever of the atomizer 320 or indirect charging device 330 (in this embodiment the atomizer 320) is to be run at the lower magnitude potential.

The following table compares the performance of the system 200 illustrated in FIG. 3 to the system 10 illustrated in FIG. 1 and the system 100 illustrated in FIG. 2.

| Transfer efficiency summary | FIG. 2 indirect charging @ −70 KV | FIG. 1 direct charging @ −70 KV | FIG. 1 direct charging @ −100 KV | FIG. 3 hybrid charging @ −40 KV/−70 KV | FIG. 3 hybrid charging @ −60 KV/−70 KV |
|---|---|---|---|---|---|
| Soft pattern full flat panel | 62.7% | 67.7% | 72.7% | 67.7% | 70.4% |
| Hard pattern full flat panel | 65.5% | | 70.1% | | |
| Soft pattern 6" (about 15.24 cm) ASTM panel array | 49.1% | 61.9% | 68.8% | | |
| Hard pattern 6" (about 15.24 cm) ASTM panel array | 39.5% | | 57.7% | | |

The system 200 illustrated in FIG. 3 thus achieves results comparable to the best results achieved with either direct or indirect charging alone, while permitting a reduction in magnitude from 70 KV to 40 KV or from 100 KV to 60 KV in the direct charging voltage. These reductions result in lower electrical stress and demand on the voltage block 212, permitting it to operate more reliably in the lower voltage range while achieving the transfer efficiency only available at much higher magnitude voltages in the prior art. These reductions also permit the use of simpler, lower cost voltage blocks 212 and high magnitude potential supplies 222.

What is claimed is:

1. An electrostatically aided coating atomizing and dispensing apparatus comprising an atomizer, a voltage block, a source of electrically non-insulative coating material to be dispensed from the atomizer, an indirect charging apparatus, and first and second sources of high magnitude electrical potential, the source of electrically non-insulative coating material being coupled to an input port of the voltage block, an output port of the voltage block being coupled to the atomizer, the indirect charging apparatus being operatively mounted with respect to the atomizer, the first source of high magnitude electrical potential being coupled to an input port of the atomizer and the second source of high magnitude electrical potential being coupled to an input port of the indirect charging apparatus.

* * * * *